US006644496B1

(12) United States Patent
Ambrosio

(10) Patent No.: US 6,644,496 B1
(45) Date of Patent: Nov. 11, 2003

(54) MEDICATION DISPENSING SYSTEM

(76) Inventor: Anthony J. Ambrosio, 36 Woodlawn Ave., Ronkonkoma, NY (US) 11779

( * ) Notice: Subject to any disclaimer, the term of this patent is extended or adjusted under 35 U.S.C. 154(b) by 48 days.

(21) Appl. No.: 10/023,504

(22) Filed: Dec. 14, 2001

(51) Int. Cl.[7] ..... G07F 11/00
(52) U.S. Cl. ..... 221/2; 221/124
(58) Field of Search ..... 221/2, 3, 7, 13, 221/15, 96, 123, 124, 131, 197; 206/534, 538

(56) References Cited

U.S. PATENT DOCUMENTS 4,717,042 A * 1/1988 McLaughlin ..... 221/3
4,911,327 A 3/1990 Shepherd et al.
D323,782 S 2/1992 McQuarrie
5,099,463 A * 3/1992 Lloyd et al. ..... 368/10
5,133,478 A 7/1992 Gordon
5,646,912 A 7/1997 Cousins
5,850,937 A * 12/1998 Rauche ..... 221/2

* cited by examiner

*Primary Examiner*—Kenneth W. Noland

(57) ABSTRACT

A medication dispensing system for providing a prompting signal for taking medication at a predetermined time. The medication dispensing system includes a main housing with a plurality of walls defining an interior space and a channel which extending from a first end towards a second end opposite of the first end; at least one container portion for temporarily storing medication to be taken by the user which is detachably couplable to the main housing and positionable substantially in the channel; and at least one alarm assembly for providing a signal to the user at a predetermined time prompting the user to take the medication.

13 Claims, 3 Drawing Sheets

MEDICATION DISPENSING SYSTEM

BACKGROUND OF THE INVENTION

1. Field of the Invention

The present invention relates to medication dispensers and more particularly pertains to a new medication dispensing system for providing a prompting signal for taking me dictation at a predetermined time.

2. Description of the Prior Art

The use of medication dispensers is know in the prior art. More specifically, medication dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,646,912; U.S. Pat. No. 5,133,478; U.S. Pat. No. 4,911,327; U.S. Pat. No. 5,850,937; U.S. Pat. No. 4,717,042; and U.S. Pat. No. Des. 323,782.

While these devices fulfill their respective, particular objectives and requirements, the aforementioned patents do not disclose a new medication dispensing system. The inventive device includes a main housing with a plurality of walls defining an interior space and a channel which extending from a first end towards a second end opposite of the first end; at least one container portion for temporarily storing medication to be taken by the user which is detachably couplable to the main housing and positionable substantially in the channel; and at least one alarm assembly for providing a signal to the user at a predetermined time prompting the user to take the medication.

In these respects, the medication dispensing system according to the present invention substantially departs from the conventional concepts and designs of the prior art, and in so doing provides an apparatus primarily developed for the purpose of providing a prompting signal for taking medication at a predetermined time.

SUMMARY OF THE INVENTION

In view of the foregoing disadvantages inherent in the known types of medication dispensers now present in the prior art, the present invention provides a new medication dispensing system construction wherein the same can be utilized for providing a prompting signal for taking medication at a predetermined time.

The general purpose of the present invention, which will be described subsequently in greater detail, is to provide a new medication dispensing system apparatus and method which has many of the advantages of the medication dispensers mentioned heretofore and many novel features that result in a new medication dispensing system which is not anticipated, rendered obvious, suggested, or even implied by any of the prior art medication dispensers, either alone or in any combination thereof.

To attain this, the present invention generally comprises a main housing with a plurality of walls defining an interior space and a channel which extending from a first end towards a second end opposite of the first end; at least one container portion for temporarily storing medication to be taken by the user which is detachably couplable to the main housing and positionable substantially in the channel; and at least one alarm assembly for providing a signal to the user at a predetermined time prompting the user to take the medication.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new medication dispensing system apparatus and method which has many of the advantages of the medication dispensers mentioned heretofore and many novel features that result in a new medication dispensing system which is not anticipated, rendered obvious, suggested, or even implied by any of the prior art medication dispensers, either alone or in any combination thereof.

It is another object of the present invention to provide a new medication dispensing system which may be easily and efficiently manufactured and marketed.

It is a further object of the present invention to provide a new medication dispensing system which is of a durable and reliable construction.

An even further object of the present invention is to provide a new medication dispensing system which is susceptible of a low cost of manufacture with regard to both materials and labor, and which accordingly is then susceptible of low prices of sale to the consuming public, thereby making such medication dispensing system economically available to the buying public.

Still yet another object of the present invention is to provide a new medication dispensing system which proves in the apparatuses and methods of the prior art some of the advantages thereof, while simultaneously overcoming some of the disadvantages normally associated therewith.

Still another object of the present invention is to provide a new medication dispensing system for providing a prompting signal for taking medication at a predetermined time.

Yet another object of the present invention is to provide a new medication dispensing system which includes a main housing with a plurality of walls defining an interior space and a channel which extending from a first end towards a second end opposite of the first end; at least one container portion for temporarily storing medication to be taken by the user which is detachably couplable to the main housing and positionable substantially in the channel; and at least one alarm assembly for providing a signal to the user at a predetermined time prompting the user to take the medication.

Still yet another object of the present invention is to provide a new medication dispensing system that provides a portable compact means of storing, transporting, and dispensing medication.

Even still another object of the present invention is to provide a new medication dispensing system that prompts the user to take medication at appropriate times, allowing the user to focus their attention on other activities.

These together with other objects of the invention, along with the various features of novelty which characterize the invention, are pointed out with particularity in the claims annexed to and forming a part of this disclosure. For a better understanding of the invention its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
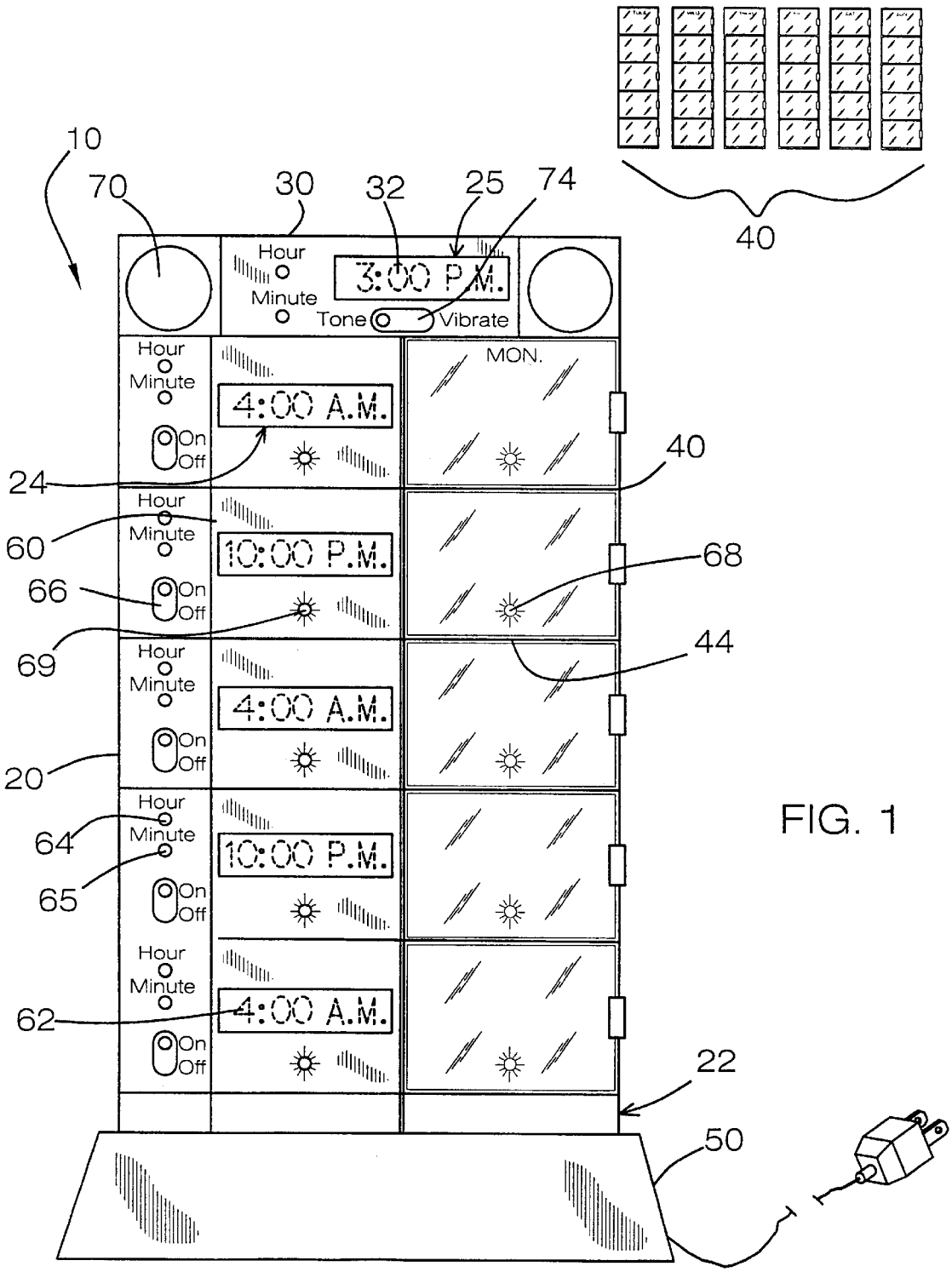
FIG. 1 is a schematic front view of a new medication dispensing system according to the present invention.
Figure 2:
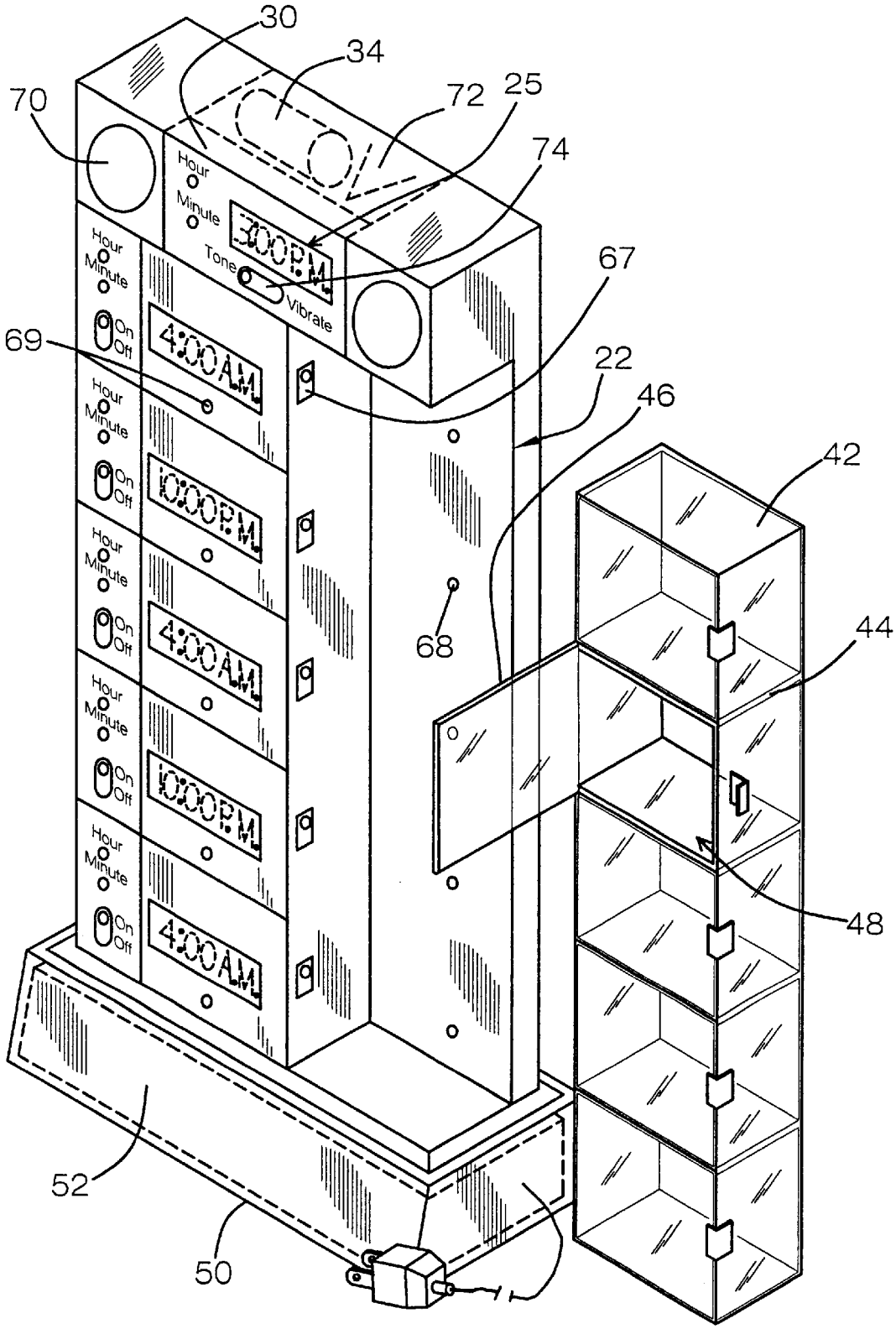
FIG. 2 is a schematic perspective view of the present invention with the main housing in the stand portion.
Figure 3:
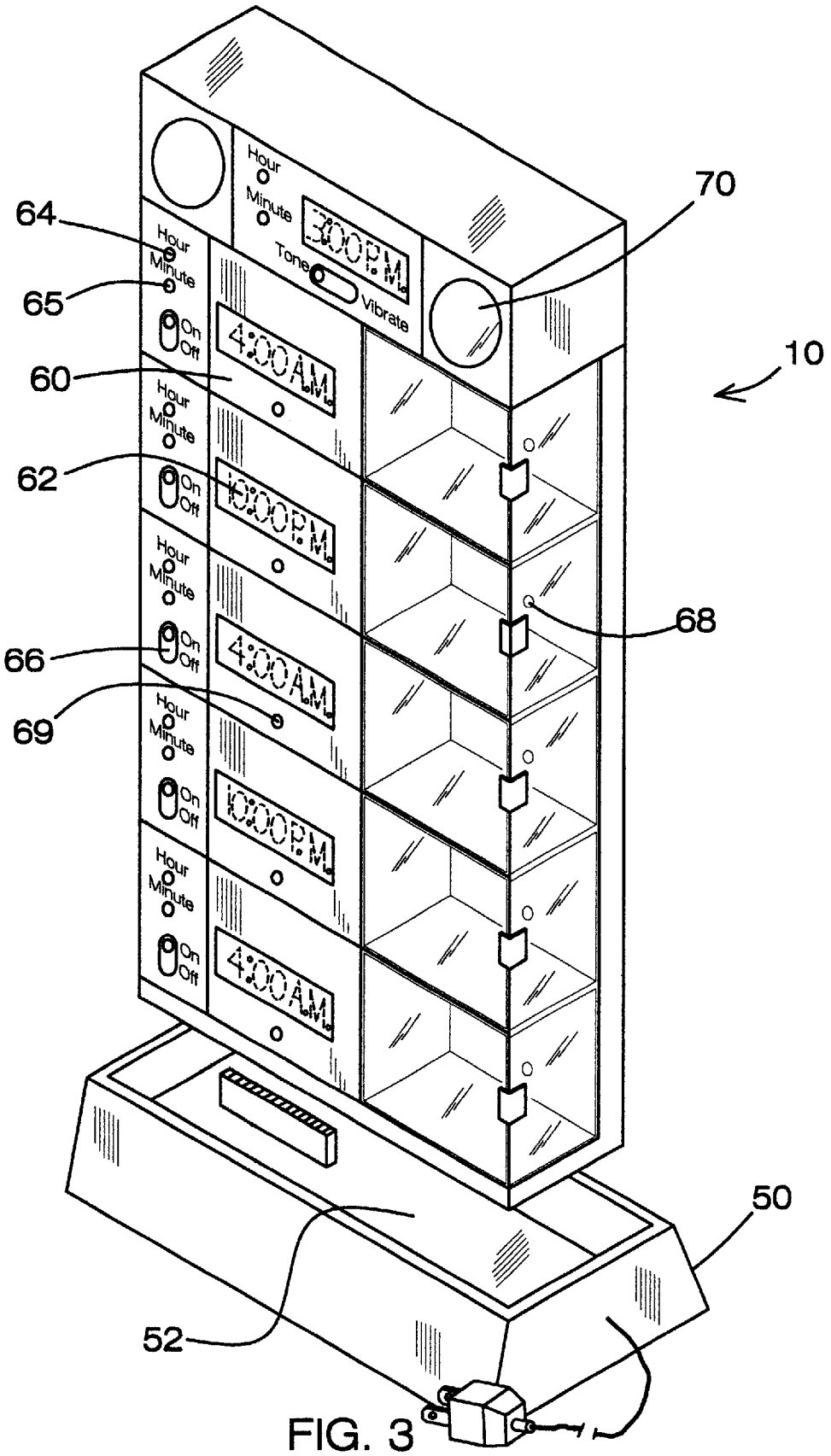
FIG. 3 is a schematic perspective view of the present invention with the main housing removed from the stand portion.

With reference now to the drawings, and in particular to FIGS. 1 through 3 thereof, a new medication dispensing system embodying the principles and concepts of the present invention and generally designated by the reference numeral 10 will be described.

As best illustrated in FIGS. 1 through 3, the medication dispensing system 10 generally comprises a main housing 20, a plurality of container portions 40, a plurality of alarm assemblies 60, a master clock 30, and a stand portion 50.

The main housing 20 includes a plurality of walls, which define an interior space. The main housing 20 includes a channel 22, which extends from a first end towards a second end of the main housing 20.

The plurality of container portions 40 is used for temporarily storing medication to be taken by the user. The container portion 40 can be coupled to and is detachable from the main housing 20. The container portion 40 is positioned substantially in the channel 22 when coupled to the main housing 20.

Each one of the plurality of alarm assemblies 60 provide a signal to the user at a predetermined time. Thus prompting the user to take the medication. Each one of the alarm assemblies 60 includes a display portion 62 and is positioned substantially within the main housing 20.

The main housing 20 includes a plurality of alarm display apertures 24. Each one of the alarm displays 62 is visible through an associated one of the alarm display apertures 24.

The master clock assembly 30 provides the user with a time reference. The master clock assembly 30 may be set by the user. The master clock assembly 30 is also positioned substantially within the main housing 20.

Similar to the alarm display apertures 24 the housing 20 may also include a master clock aperture 25 which extends through a first one of the plurality of walls. The master clock assembly 30 includes a display portion 32. The display portion 32 is visible through the master clock aperture 25.

In an embodiment each one of the alarm assemblies 60 further comprises an hour set button 64, a minute set button 65, a signal reset button 66 and an alarm assembly power switch 67. The hour set button 64 is used for setting a time associated with the alarm assembly 60 for prompting the user to take medication. The minute set button 65 is used in conjunction with the hour set button 64 for setting a time associated with the alarm assembly 60 for prompting the user to take medication. The signal reset switch 66 is used to terminate the signal used to prompt the user. The signal reset switch 66 is a momentary switch such that toggling the signal rest switch 66 to terminate the signal also resets the associated alarm assembly 60 for the next 24-hour period. The alarm assembly power switch 67 is used for activating and deactivating the alarm assembly 67.

In a further embodiment each one of the container portions 40 further comprises a substantially transparent housing 42 and a plurality of lid portions 46. The substantially transparent housing 42 includes a bottom wall, four side walls, and a plurality of internal divider walls 44 for subdividing the housing 42 into a plurality of medication holding portions 48. Each of the medication holding portion 48 has a one-to-one correspondence with an associated one of the plurality of alarm assemblies 60. Each one of the lid portions 46 is for selectively closing an associated one of the medication holding portions 48.

In still a further embodiment each one of the alarm assemblies 60 further comprises a light emitting diode 68, which is positioned substantially underneath the bottom wall of an associated one of the medication holding portions 48. When the alarm assembly 60 is triggered the light emitting diode 68 is illuminated providing a visual indication of which medication is to be taken by the user.

In yet a further embodiment each one of the alarm assemblies 60 further comprises a second light emitting diode 69 which is preferably positioned substantially adjacent to the display portion 62. When the alarm assembly 60 is triggered the second light emitting diode 69 is illuminated providing a visual indication of which medication is to be taken by the user.

In still yet a further embodiment the master clock assembly 30 is operationally coupled to each one of the plurality of alarm assemblies 60 such that each alarm assembly 60 is synchronized off of the time reference.

At least one audible tone generator 70 is operationally coupled to each one of the alarm assemblies 601. The audible tone generator 70 provides an audible alarm for each one of the alarm assemblies 60 prompting the user to take the appropriate medication positioned in an associated one of the medication holding portions 48.

A vibrator 72 is also operationally coupled to each one of the alarm assemblies 60. The vibrator 72 provides a tactile alarm for each one of the alarm assemblies 60 prompting the user to take the appropriate medication positioned in an associated one of the medication holding portions 48.

A mode selection switch 74 may be positioned on a wall of the main housing 20 allowing the user to select between an audible and a tactile (private) signal.

The stand portion 50 is used for selectively receiving the main housing 20. The stand portion 50 includes an ac adapter and battery charger assembly 52. which is couplable to a standard household electrical outlet. The ac adapter and battery charger assembly 52 is operationally couplable to a battery 34 positioned within the main housing 20 when the main housing 20 is received by the stand portion 50.

In an embodiment the plurality of container portions 40 comprises seven container portions 40. Each one of the container portions 40 is uniquely associated with a day of the week such that each one of the container portions 40 may be coupled to the main housing 20 for use during an associated day of the week and the user only need to refill each one of the container portions 40 once for a week of use.

In still yet a further embodiment each one of the alarm assembly power switches 67 is positioned substantially behind the container portion 40 when the container portion 40 is coupled to the main housing 20 such that an associated alarm assembly 60 can not be accidentally deactivated by the user.

In use, the user sets the master clock to the current time. The user then sets each one of the alarm assemblies to a time associated with the taking of medication by the user. If any of the alarms are not needed, the unneeded alarm(s) may be deactivated using the associated alarm assembly power switch. The user then fills each one of the medication holding portions of each of the container portions with the associated medication corresponding with the time set for each one of the alarm assemblies. The container portion for the current or appropriate day is then coupled to the main housing and the system is ready to prompt the user as required.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A medication dispensing system for prompting a user comprising:

a main housing having a plurality of walls defining an interior space, said main housing having a channel extending from a first end towards a second end opposite of said first end;

at least one container portion for temporarily storing medication to be taken by the user, said container portion being detachably couplable to said main housing, said container portion being positionable substantially in said channel;

at least one alarm assembly for providing a signal to the user at a predetermined time prompting the user to take the medication;

a plurality of alarm assemblies, each one of said alarm assemblies having a display portion, each one of said plurality of alarm assemblies being positioned substantially within said housing;

said housing having a plurality of alarm display apertures, each one of said alarm displays being visible through an associated one of said alarm display apertures;

an hour set button for setting a time associated with said alarm assembly for prompting the user to take medication;

a minute set button for setting a time associated with said alarm assembly in conjunction with said hour set button for prompting the user to take medication;

a signal reset switch for terminating said signal used to prompt the user; said signal reset switch being a momentary switch such that toggling said signal rest switch to terminate said signal also resets said associated alarm assembly for the next 24-hour period; and an alarm assembly power switch for activating/deactivating said alarm assembly.

2. The medication dispensing system of claim 1, further comprising:

a master clock assembly for providing the user with a time reference, said master clock assembly being settable by the user, said master clock assembly being positioned substantially within said main housing;

said housing having a master clock aperture extending through a first one of said plurality of walls, said master clock assembly having a display portion, said display portion being visible through said master clock aperture.

3. A medication dispensing system for prompting a user comprising:

a main housing having a plurality of walls defining an interior space, said main housing having a channel extending from a first end towards a second end opposite of said first end;

at least one container portion for temporarily storing medication to be taken by the user, said container portion being detachably couplable to said main housing, said container portion being positionable substantially in said channel;

a plurality of alarm assemblies for providing a signal to the user at a predetermined time prompting the user to take the medication, each one of said alarm assemblies having a display portion, each one of said plurality of alarm assemblies being positioned substantially within said housing;

said housing having a plurality of alarm display apertures, each one of said alarm displays being visible through an associated one of said alarm display apertures;

a master clock assembly for providing the user with a time reference, said master clock assembly being settable by the user, said master clock assembly being positioned substantially within said main housing;

said housing having a master clock aperture extending through a first one of said plurality of walls, said master clock assembly having a display portion, said display portion being visible through said master clock aperture;

wherein each one of said alarm assemblies further comprises:

an hour set button for setting a time associated with said alarm assembly for prompting the user to take medication;

a minute set button for setting a time associated with said alarm assembly in conjunction with said hour set button for prompting the user to take medication;

a signal reset switch for terminating said signal used to prompt the user; said signal reset switch being a momentary switch such that toggling said signal rest switch to terminate said signal also resets said associated alarm assembly for the next 24-hour period;

an alarm assembly power switch for activating/deactivating said alarm assembly.

4. The system of claim 3, wherein said container portion further comprises:

a substantially transparent housing having a bottom wall, four side walls, and a plurality of internal divider walls for subdividing said housing;

said container portion being subdivided into a plurality of medication holding portions, each medication holding portion having a one-to-one correspondence with an associated one of said plurality of alarm assemblies;

said container portion having a plurality of lid portions, each one of said lid portions being for selectively closing an associated one of said medication holding portions.

5. The system of claim 4, wherein each one of said alarm assemblies further comprises a light emitting diode positioned substantially underneath said bottom wall of an associated one of said medication holding portions such that when said alarm assembly is triggered said light emitting diode is illuminated providing a visual indication of which medication is to be taken by the user.

6. The system of claim 4, wherein each one of said alarm assemblies further comprises a second light emitting diode positioned substantially adjacent to said display portion such that when said alarm assembly is triggered said second light emitting diode is illuminated providing a visual indication of which medication is to be taken by the user.

7. The system of claim 4, wherein said master clock assembly is operationally coupled to each one of said plurality of alarm assemblies such that each alarm assembly is synchronized off of said time reference.

8. The system of claim 4, further comprising at least one audible tone generator operationally coupled to each one of said alarm assemblies, said audible tone generator providing an audible alarm for each one of said alarm assemblies prompting the user to take the appropriate medication positioned in an associated one of said medication holding portions.

9. The system of claim 4, further comprising a vibrator operationally coupled to each one of said alarm assemblies, said vibrator providing an tactile alarm for each one of said alarm assemblies prompting the user to take the appropriate medication positioned in an associated one of said medication holding portions.

10. The system of claim 4, further comprising:

a stand portion for selectively receiving said main housing, said stand portion having an ac adapter and battery charger assembly, said ac adapter and battery charger assembly being couplable to a standard household electrical outlet;

said ac adapter and battery charger assembly being operationally couplable to a battery positioned within said main housing when said main housing is received by said stand portion.

11. A medication dispensing system for prompting a user comprising:

a main housing having a plurality of walls defining an interior space, said main housing having a channel extending from a first end towards a second end opposite of said first end;

a plurality of container portions for temporarily storing medication to be taken by the user, said container portion being detachably couplable to said main housing, said container portion being positionable substantially in said channel;

a plurality of alarm assemblies for providing a signal to the user at a predetermined time prompting the user to take the medication, each one of said alarm assemblies having a display portion, each one of said plurality of alarm assemblies being positioned substantially within said housing;

said housing having a plurality of alarm display apertures, each one of said alarm displays being visible through an associated one of said alarm display apertures;

a master clock assembly for providing the user with a time reference, said master clock assembly being settable by the user, said master clock assembly being positioned substantially within said main housing;

said housing having a master clock aperture extending through a first one of said plurality of walls, said master clock assembly having a display portion, said display portion being visible through said master clock aperture;

wherein each one of said alarm assemblies further comprises:

an hour set button for setting a time associated with said alarm assembly for prompting the user to take medication;

a minute set button for setting a time associated with said alarm assembly in conjunction with said hour set button for prompting the user to take medication;

a signal reset switch for terminating said signal used to prompt the user; said signal reset switch being a momentary switch such that toggling said signal rest switch to terminate said signal also resets said associated alarm assembly for the next 24-hour period;

an alarm assembly power switch for activating/deactivating said alarm assembly;

wherein each one of said container portions further comprises:

a substantially transparent housing having a bottom wall, four side walls, and a plurality of internal divider walls for subdividing said housing;

said container portion being subdivided into a plurality of medication holding portions, each medication holding portion having a one-to-one correspondence with an associated one of said plurality of alarm assemblies;

said container portion having a plurality of lid portions, each one of said lid portions being for selectively closing an associated one of said medication holding portions;

wherein each one of said alarm assemblies further comprises a light emitting diode positioned substantially underneath said bottom wall of an associated one of said medication holding portions such that when said alarm assembly is triggered said light emitting diode is illuminated providing a visual indication of which medication is to be taken by the user;

wherein each one of said alarm assemblies further comprises a second light emitting diode positioned substantially adjacent to said display portion such that when said alarm assembly is triggered said second light emitting diode is illuminated providing a visual indication of which medication is to be taken by the user;

wherein said master clock assembly is operationally coupled to each one of said plurality of alarm assemblies such that each alarm assembly is synchronized off of said time reference;

at least one audible tone generator operationally coupled to each one of said alarm assemblies, said audible tone generator providing an audible alarm for each one of said alarm assemblies prompting the user to take the appropriate medication positioned in an associated one of said medication holding portions;

a vibrator operationally coupled to each one of said alarm assemblies, said vibrator providing an tactile alarm for each one of said alarm assemblies prompting the user to take the appropriate medication positioned in an associated one of said medication holding portions;

a stand portion for selectively receiving said main housing, said stand portion having an ac adapter and battery charger assembly, said ac adapter and battery charger assembly being couplable to a standard household electrical outlet;

said ac adapter and battery charger assembly being operationally couplable to a battery positioned within said main housing when said main housing is received by said stand portion.

12. The system of claim 11, wherein said plurality of container portions comprises seven container portions, each one of said container portions being associated with a day of the week such that each one of said container portions may be coupled to said main housing for use during an associated day of the week and the user only need to refill each one of said container portions once for a week of use.

13. The system of claim 11, wherein each one of said alarm assembly power switches is positioned substantially behind said container portion when said container portion is coupled to said main housing such that an associated alarm assembly can not be accidentally deactivated by the user.

* * * * *